US006236733B1

(12) United States Patent
Kato et al.

(10) Patent No.: US 6,236,733 B1
(45) Date of Patent: May 22, 2001

(54) LOUDSPEAKER

(75) Inventors: Toshifumi Kato; Satoshi Hachiya; Takeshi Iwata, all of Yamagata-ken (JP)

(73) Assignees: Pioneer Electronic Corporation, Tokyo (JP); Tohoku Pioneer Electronic Corporation, Yamagata-ken (JP)

( * ) Notice: Subject to any disclaimer, the term of this patent is extended or adjusted under 35 U.S.C. 154(b) by 0 days.

(21) Appl. No.: 09/324,729

(22) Filed: Jun. 3, 1999

(30) Foreign Application Priority Data

Jun. 5, 1998 (JP) ..... 10-174078

(51) Int. Cl.[7] ..... H04R 25/00

(52) U.S. Cl. ..... 381/423; 381/184; 381/398; 381/424; 181/164; 181/166

(58) Field of Search ..... 381/184, 186, 381/342, 347, 398, 403, 404, 405, 417, 418, 423, 424; 181/148, 157, 164, 166, 173

(56) References Cited

U.S. PATENT DOCUMENTS

| | | | | |
|---|---|---|---|---|
| 2,004,735 | * | 6/1935 | Thomas | 381/426 |
| 2,007,746 | * | 7/1935 | Ringel | 381/424 |
| 2,231,479 | * | 2/1941 | Perry | 381/424 |
| 3,991,286 | * | 11/1976 | Henricksen | 381/404 |
| 4,146,756 | * | 3/1979 | Kito et al. | 381/404 |

* cited by examiner

*Primary Examiner*—Curtis Kuntz
*Assistant Examiner*—Suhan Ni
(74) *Attorney, Agent, or Firm*—Arent Fox Kintner Plotkin & Kahn, PLLC

(57) ABSTRACT

A loudspeaker has a frame, a magnetic circuit formed on the frame, a voice coil bobbin disposed in a magnetic gap of the magnetic circuit, and a diaphragm connected to the voice coil bobbin at an inner periphery and to the frame at an outer periphery thereof. The diaphragm is folded at a position between the inner and outer peripheries to form an annular ridge. The ridge is projected in an axially inner direction of the loudspeaker.

4 Claims, 4 Drawing Sheets

LOUDSPEAKER

BACKGROUND OF THE INVENTION

The present invention relates to a loudspeaker, and more particularly to a diaphragm provided in the loudspeaker and the structure of members surrounding the diaphragm in a loudspeaker.

A loudspeaker provided in an audio system is an electroacoustic device that converts an electric signal (electrical energy) into an acoustic signal (sound energy). On the basis of operational principles, the loudspeakers are roughly divided into electrodynamic, electrostatic, piezoelectric, discharge, and electromagnetic speakers. Electrodynamic loudspeakers, which are superior in reproduced frequency range and converting efficiency are widely used today.

One of the electrodynamic loudspeaker is a cone loudspeaker. FIG. 6 shows an example of a conventional cone loudspeaker. Referring to the figure, the conventional cone loudspeaker has a pole yoke 106, magnet 104 mounted on the yoke 106, and a plate 105 mounted on the magnet, thereby forming a magnetic circuit 107 including an annular magnetic gap. A frame 112 is attached to the plate 105.

A conical diaphragm 101 having a center hole is mounted above the pole yoke 106. The outer periphery of the diaphragm 101 is secured to the frame 112 through an edge 108 having appropriate compliance and rigidity.

A cylindrical voice coil bobbin 103 is provided in the hole of the diaphragm 101, the upper periphery attached thereto. A voice coil 102 is mounted in a space surrounding the bobbin 103.

The voice coil bobbin 103 is supported by the frame 112 through an annular damper 109 having an appropriate compliance and stiffness. The outer periphery of the damper 109 and the edge 108 are secured to the frame 112 integral with the magnetic circuit 107 so as to resiliently support the diaphragm 101 and the voice coil bobbin 103 at the respective predetermined static positions within the magnetic gap without contacting the members of the magnetic circuit 107.

The ends of the voice coil 102 are connected to conductive leads 111. Each lead 111 is connected to a terminal 110 provided on the frame 112.

In order to reinforce the structural strengths of the diaphragm 101 and the voice coil 102, a center cap 113 is mounted on the center portion of the diaphragm 101, so as to cover the center hole thereof. Hence partial vibrations of the diaphragm 101 and the voice coil 102 are prevented.

In the thus constructed loudspeaker, when applied with audio current through the terminals 110 and the leads 111, the voice coil 102 is electromagnetically driven in the magnetic gap of the magnetic circuit in the vibrating direction of the diaphragm 101. Thus, the diaphragm 101 is vibrated in the axial direction, thereby generating sounds.

Hence, it is possible for the diaphragm 101 to be deflected toward the front in the vibrating direction until the edge 108 is fully tensed. In the rearward direction, the diaphragm 101 can be deflected until the inner periphery of the damper 109 attached to the voice coil bobbin 103 abuts against the plate 105. Such a range is the maximum vibrating quantity of the loudspeaker.

Since the center cap 113 integrally vibrates with the diaphragm 101, the center cap 113 serves to radiate a part of the acoustic energy, mainly the sounds in the high frequency range. In addition, the center cap 113 compensates the deflection in the phase of the sound waves caused by interference which is generated due to the shape of the diaphragm 101, thereby adjusting the acoustic characteristics of the loudspeaker, and further corrects as necessary, the influence of the center hole of the diaphragm 101 on the acoustic characteristics.

The loudspeaker is recently used not only as an independent device composing an audio system, but also disposed in a door of a motor vehicle, a casing of a flat electronic display, and in other small spaces within casings of various shapes. In such a instance, it is necessary to manufacture a thin loudspeaker which is reduced in height as much as possible so that the loudspeaker may be easily mounted in a casing of a limited size.

In order to reduce the thickness of the conventional corn loudspeaker, the height of the diaphragm, which takes up most of the height of the loudspeaker, must be reduced. The height of the speaker can be reduced by increasing the half vertical angle θ formed between the diaphragm and the voice coil bobbin as shown in FIG. 6, provided the caliber, that is the outer circumferential diameter of the diaphragm is the same.

In the cone loudspeaker, as the half vertical angle θ decreases, the rigidity of the diaphragm in the vibrating direction generally increases, thereby restraining the partial vibration of the diaphragm. As a result, the reproduction frequency range of the loudspeaker can be expanded to the higher frequency range. However, the partial vibration is liable to occur as the vertical angel increases under the same condition concerning the caliber and the material of the diaphragm. Thus, there occurs disturbances in the reproduced frequency response so that the reproduction frequency range becomes limited, especially in a high frequency range. Therefore, if the reproduction frequency in the high frequency range is to be maintained to a degree, the vertical angle cannot be largely increased.

Moreover, since the diaphragm vibrates in the axial direction when the loudspeaker is in operation, in a case of the speaker mounted in a casing, the actual height of the speaker is determined in consideration to the amplitude of the diaphragm. As is widely known, if the loudspeaker is mounted on an infinite rigid wall for example, the amplitude of the diaphragm is inversely proportional to the square of a frequency in a constant output range wherein the axial vibration occurs, and the amplitude becomes maximum at a frequency approximately equal to the minimum resonance frequency. Furthermore, the amplitude increases in proportion to the driving input of the loudspeaker.

Consequently, in order to set the minimum resonance frequency of the speaker at a low frequency so that the reproduction frequency range is more or less extended in a lower frequency range in a casing having a limited inner space, the maximum amplitude of the diaphragm must be increased. Hence a space which allows the diaphragm to be projected at the maximum amplitude must be provided in the casing wherein the speaker is mounted. The thickness of the speaker must be reduced to provide for such a space.

In addition, in order to allow the maximum vibration of the diaphragm, the distance between the damper 109 and the plate 105 must be so designed as to be proportional to the maximum amplitude. Thus the height of the voice coil bobbin 103 is increased, thereby increasing the height of the speaker.

Moreover, when increasing the allowable input of the loudspeaker, since a large amplitude is necessary, the size of a mounting portion in the casing, and the height of voice coil bobbin 103 must be increased as described above. When the height of the voice coil bobbin 103 is increased, the vertical position of the voice coil 102 which is electromagnetically driven is deviated from the vertical position of the inner periphery of the damper 109, thereby destabilizing the resilient support of the voice coil 102, voice coil bobbin 103 and the diaphragm 101 in the vibrating direction. As a result, a so-called rolling of the voice coil and the voice coil bobbin frequently occurs when the loudspeaker is driven.

When the rolling occurs, voice coil 102 and voice coil bobbin 103 violently crash and rub against the plate 105 and the pole yoke 106 in the magnetic gap, so that an allophone is generated from the diaphragm 101, and in extreme cases, the voice coil 102 is cut. Hence the amplitude cannot be increased although the height of the voice coil bobbin 103 is increased. Consequently, the allowable input of the loudspeaker cannot be increased.

Thus, there is a limit in decreasing the thickness of a conventional loudspeaker wherein the wide reproduction frequency range and allowable input are necessary.

SUMMARY OF THE INVENTION

An object of the present invention is to provide a loudspeaker having a small thickness wherein a wide reproduction frequency range including the low to high frequency ranges is obtained.

According to the present invention, there is provided a loudspeaker having a frame, a magnetic circuit formed on the frame, a voice coil bobbin disposed in a magnetic gap of the magnetic circuit, and a diaphragm connected to the voice coil bobbin at an inner periphery and to the frame at an outer periphery thereof, wherein the diaphragm is folded at a position between the inner and outer peripheries to form an annular ridge, whereby the ridge is projected in an axially inner direction of the loudspeaker.

These and other objects and features of the present invention will become more apparent from the following detailed description with reference to the accompanying drawings.

DETAILED DESCRIPTION OF THE PREFERRED EMBODIMENT

Figure 1A:
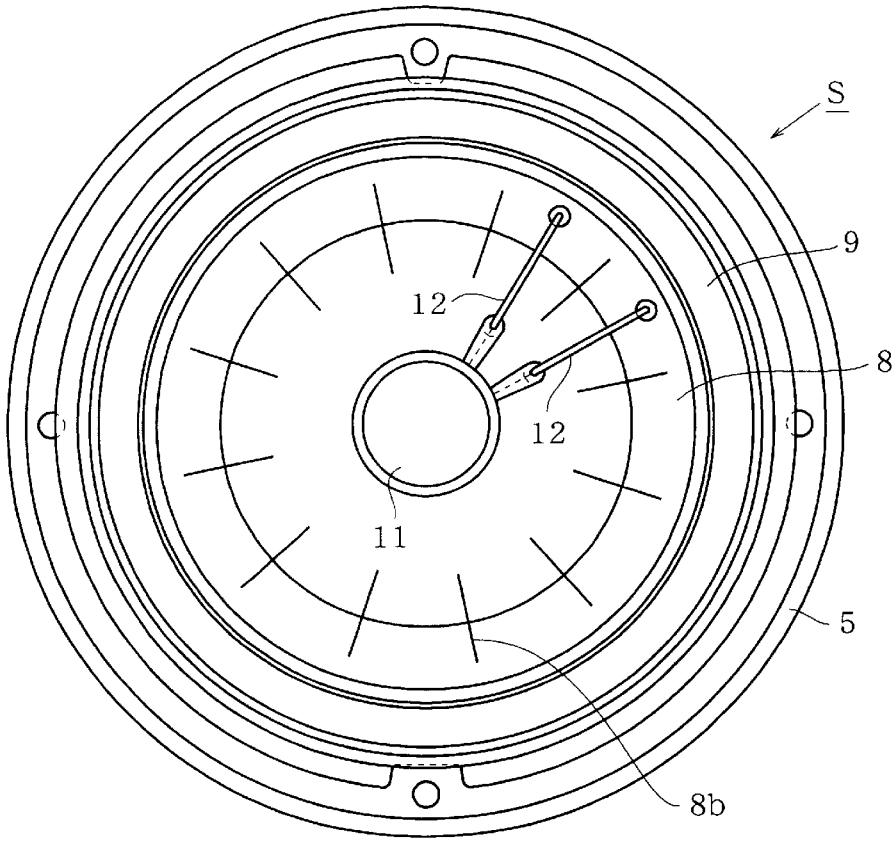
FIG. 1*a* is a plan view showing a loudspeaker according to the present invention.
Figure 1B:
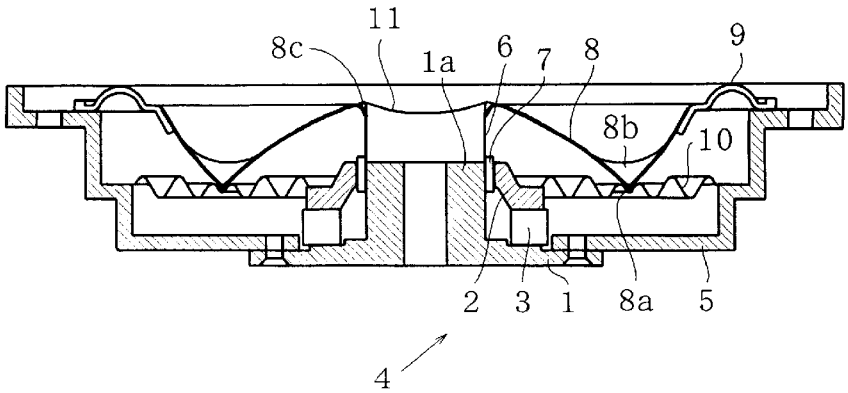
FIG. 1*b* is a sectional view of a part of the loudspeaker.

FIG. 1*a* shows a structure of a loudspeaker S of the present invention as viewed from the upper side, that is a sound radiating side, of the loudspeaker, and FIG. 1*b* shows the main part of the loudspeaker S in section.

Referring to FIGS. 1*a* and 1*b,* the loudspeaker S of the present invention has a yoke 1 having an upwardly extending annular pole piece 1*a,* annular magnet 3 mounted on the yoke 1 surrounding the pole piece 1*a,* and an annular plate 2 mounted on the magnet 3, thereby forming an externally magnetized magnetic circuit 4 including an annular magnetic gap. The magnetic gap is formed between the pole piece 1*a* and the plate 2, the distance there-between being maintained substantially constant along the entire length. A frame 5 made of synthetic resin, for example, is secured to the outer periphery of the yoke 1, thereby attaching the magnetic circuit 4 to the frame 5. The magnetic circuit 4 and the frame 5 consist a magnetic circuit assembly.

A cylindrical voice coil bobbin 6 is provided on the pole piece 1*a*. A voice coil 7 is mounted in a space between the plate 2 and the pole piece 1*a,* and attached to the bobbin 6, so that at least a part thereof is provided in the magnetic gap.

A diaphragm 8 molded out of synthetic resin, for example, has an inner hole 8*c* in which the voice coil bobbin 6 is disposed, thereby forming an annular sound radiating surface extending from the inner periphery to the outer periphery thereof. The voice coil bobbin 6 is adhered to the diaphragm 8 by an adhesive, so that the inner periphery of the diaphragm is attached to the upper end of the voice coil bobbin 6.

An edge 9 is provided on the outer periphery of the diaphragm 8. The edge 9 is an annular roll edge having appropriate compliance and stiffness. The inner periphery of the edge 9 is adhered to the outer periphery of the diaphragm 8 by an adhesive, while the outer periphery of the edge 9 is adhered to the frame 5 by an adhesive. The diaphragm 8 is thus attached to the frame 5 through the edge 9 which resiliently supports the outer periphery of the diaphragm 8.

The diaphragm 8 of the present invention is folded at a position between the inner and outer peripheries, thereby forming an axially inwardly projecting annular ridge 8*a* in a shape of a rib, which will be described later in detail.

A center cap 11 comprising a spherical plate having an outer diameter substantially equal to the inner diameter of the voice coil bobbin 6 for example, is adhered on the voice coil bobbin 6 by an adhesive so that the convex side thereof projects into the bobbin. Thus, the center cap 11 is connected to the voice coil bobbin 6 and/or the diaphragm 8.

An annular damper 10 is so mounted in the frame 5 that the inner periphery thereof is secured to the plate 2 and the outer periphery is attached to the inner wall of the frame 5. The damper 10 has concentric corrugations and comprises a piece of fabric soaked in resin, molded by heat, and formed into an annular shape. The ridge 8*a* of the diaphragm 8 is attached along the portion between the inner and outer peripheries of the damper 10, thereby resiliently supporting the diaphragm 8.

Thus, when the loudspeaker is in a still state, namely when the loudspeaker is not operated, the damper 10 resiliently supports the diaphragm 8, center cap 11, voice coil bobbin 6, and the voice coil 7 as well as the edge 9 at their respective predetermined positions. The voice coil 7 and the voice coil bobbin 6 disposed in the magnetic gap are further resiliently supported at the respective predetermined positions by the damper 10 so as not to abut against the members comprising the magnetic circuit such as the pole piece 1*a* and the plate 2.

In addition, when the speaker is in operation, the damper 10 resiliently supports the center cap 11, diaphragm 8, voice coil bobbin 6 and the voice coil 7 in the vibrating direction.

The diaphragm 8 is thus attached at the inner periphery thereof to the voice coil bobbin 6 and supported by the edge at the outer periphery.

Referring to FIG. 1*b,* both ends of the voice coil 7 are directed out of the coil bobbin 6 along the upper surface of the diaphragm 8 so as to be electrically connected to a pair of leads 12 at a position adjacent the inner periphery thereof as shown in FIG. 1*a*.

Figure 2:
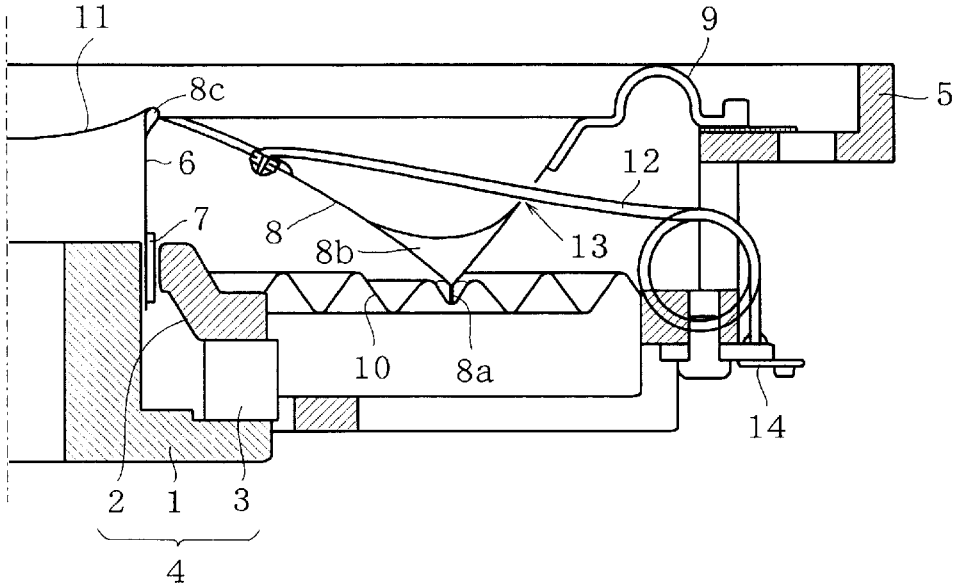
FIG. 2 is an enlarged sectional view of the loudspeaker showing a lead.

Referring to FIG. 2, each of the leads 12 of the loudspeaker S comprises a litz wire consisting of a plurality of fine electric wires twisted together and which is highly resistible against bending. Each lead 12 is further allowed to pass through a hole 13 formed in the diaphragm 8 so as to be connected to one of a pair of positive and negative input terminals 14. As shown in FIG. 2, the lead 12 is wired, or styled, in the air, thereby preventing the contact of the lead 12 with the diaphragm 8 at the hole 13. While the diaphragm 8 vibrates, the lead 12 moves in parallel with the hole 13 in accordance with the vibration so as not to abut against the diaphragm 8. Hence allophone is not liable to be generated.

In accordance with the present invention, the diaphragm 8 is folded to form the ridge 8*a* so that the entire height of the loudspeaker S is decreased and the partial vibration of the diaphragm 8 is prevented when in operation.

More particularly, as shown in FIG. 1*b,* the diaphragm 8 is folded so that the ridge 8*a* is positioned at axially inner side with respect to the sound radiating side than the inner and outer peripheries of the diaphragm 8.

Figure 3:
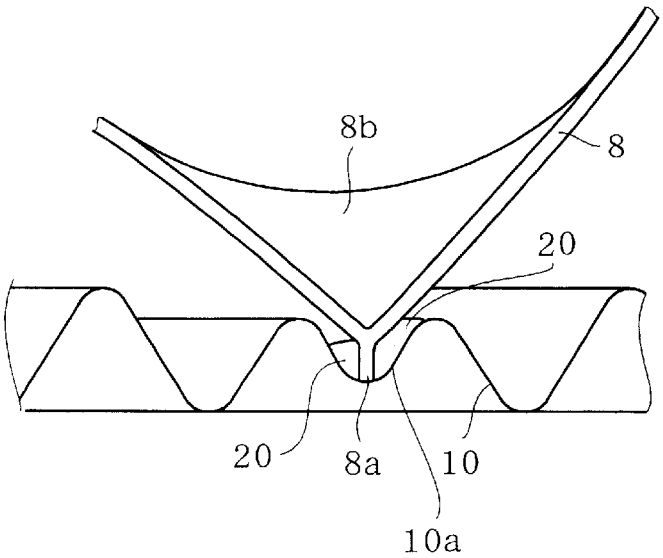
FIG. 3 is an enlarged sectinal view showing a part of the diaphragm according to the present invention.

Referring to FIG. 3, showing the folded portion in detail, the ridge 8*a* is an annular wall made of synthetic resin and integrally formed with the diaphragm 8 on the underside of the diaphragm opposite to the sound radiating side along the folded portion. The ridge 8*a* is disposed in one of a plurality of annular recess 10*a* formed as a result of the corrugation of the damper 10 adjacent the middle portion of the radius thereof. The ridge 8*a* is attached in the recess 10*a* by an adhesive 20, for example.

Since the ridge 8*a* is an annular wall, an area thereof which adheres to the damper 10 is increased so that the strength of the adherence to the damper is improved. In addition, the ridge 8*a* and the recess 10*a* of the damper 10 cooperates to determine the relative positions of the diaphragm 8 and damper 10 when attaching. Thus, the diaphragm 8 to which the edge 9 and the voice coil bobbin 6 are attached, can be easily and accurately secured to the damper 10 mounted on the frame assembly beforehand. As a result, the assembling operation for the loudspeaker is improved.

The damper 10 supports the ridge 8*a* of the damper from outer and inner peripheral sides of the ridge. Namely, the inner surface of the ridge 8*a* is adhered in the recess 10*a* to the inner peripheral portion thereof while the inner periphery of the damper 10 is fixed to the magnetic circuit 4. On the other hand, the outer surface of the ridge 8*a* is adhered in the recess 10*a* to the outer peripheral portion thereof while the outer periphery of the damper 10 is fixed to the frame 5. Thus, the diaphragm 8 is supported not at the inner or outer periphery, but at the middle between the peripheries. Thus the diaphragm 8 can be stably and resiliently supported in the vibrating direction of the diaphragm.

Since the damper 10 supports the ridge 8*a* of the diaphragm 8 at the middle portion thereof, the outer peripheral portion of the damper 10 which supports the outer periphery of the diaphragm 8 and the inner peripheral portion of the damper which supports the inner periphery of the diaphragm are both subjected to substantially the same resilience and a supporting or deflecting stroke. Accordingly, although the inner peripheral portion and the outer peripheral portion of the damper 10 independently support the inner and outer peripheries of the diaphragm 8, respectively, the resonance frequency of the damper 10 is not diffused in a complicated manner so that the acoustic characteristic of the loudspeaker becomes stable.

As shown in FIGS. 1*b,* 2 and 3, a plurality of radially extending reinforcement ribs 8*b* may further be disposed on the upper surface, namely the sound radiating side, of the diaphragm 8. Each of the reinforcement ribs 8*b* may comprise, for example, a reinforcement plate made of synthetic resin formed on the diaphragm 8. Each rib 8*b* extends across the ridge 8*a* and bridges the opposite surfaces of the diaphragm 8 adjacent the ridge 8*a*. The rib 8*b* hence buttresses the folded portion of the diaphragm 8 and prevents the unnecessary partial vibration.

In the loudspeaker of the present embodiment, since the reinforcement ribs 8*b* made of synthetic resin are integrally formed with the diaphragm, even the diaphragm 8 having such a complicated structure can be easily and accurately formed.

In operation, when an audio signal is applied to the input terminals 14, a current corresponding to the audio signal is applied to the voice coil 6 through the lead 12. The voice coil 7 suspended in the magnetic gap is accordingly electromagnetically driven so that the center cap 11 and the diaphragm 8 are vibrated in the axial direction through the voice coil bobbin 6, while being supported by the edge 9 and the diaphragm 10. Thus sound energy corresponding to the audio signal is thus radiated from the diaphragm 8.

The diaphragm 8 has a vibrating surface extending from the inner periphery to the outer periphery which is folded, so that the height from the ridge 8*a* to the inner or outer periphery of the diaphragm 8 becomes the entire height of the diaphragm. Thus the entire height of the diaphragm can be decreased compared to the conventional cone diaphragm having the same caliber, that is the outer diameter of the diaphragm, and the same voice coil diameter, that is the inner diameter of the center hole of the diaphragm. Moreover, the folded portion is reinforced so that unnecessary partial vibration of the diaphragm 8 during the operation of the loudspeaker S is prevented.

The loudspeaker S is thus constructed so that, due to the reduced height of the diaphragm 8, the entire height of the loudspeaker S is also reduced.

In addition, in the loudspeaker S, since the voice coil bobbin 6 is not attached to the damper 10, the damper is prevented from colliding against the plate 2 at the vibration. As a result, not only the maximum amplitude of the speaker S can be increased, but also the height of the voice coil bobbin can be reduced, thereby further enabling to reduce the height of the speaker.

Moreover, as shown in FIG. 1*b,* the damper 10 supporting the ridge 8*a* can be positioned with respect to the vertical direction adjacent the electromagnetically driven voice coil 7. Furthermore, the diaphragm 8 is supported at the annular ridge 8*a* which is coaxial with the voice coil bobbin 6 but larger in diameter. Thus the voice coil 7, voice coil bobbin 6 and the diaphragm 8 can be stably and resiliently supported in the vibrating direction at the vibration of the diaphragm 8, thereby restraining the occurrence of rolling when the loudspeaker S is driven.

The voice coil 7, voice coil bobbin 6, and the diaphragm 8 are thus stably and axially vibrated at the operation of the loudspeaker S, so that the rolling of the diaphragm 8 is less likely to occur. Hence the voice coil 7 and the voice coil bobbin 6 do not abut against the pole piece 1*a* or the plate 2, thereby increasing the allowable input of the loudspeaker S.

Figure 4:
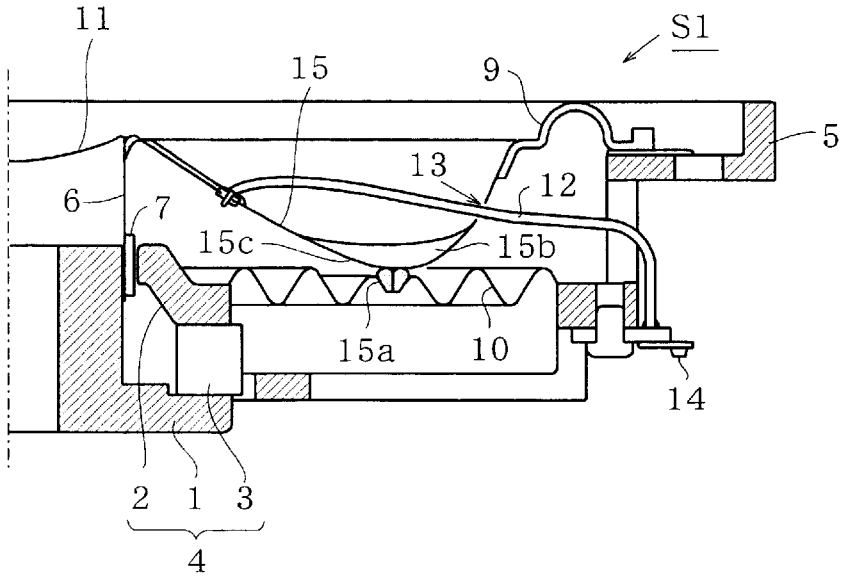
FIGS. 4 and 5 are sectinal views of modifications of the loudspeaker of the present invention.

In the hereinbefore described embodiment, the diaphragm 8 is folded at an acute angle forming the ridge 8*a* at the folded portion. However, the present embodiment may be modified as shown in a loudspeaker S1 of FIG. 4, that each of the opposite sides of a diaphragm 15 is curved to form a cup 15*c* in section. A ridge 15*a* is formed at the folded portion and a reinforcement ribs 15*b* similar to the ridge 8*a* and the ribs 8*b* are provided.

Figure 5:
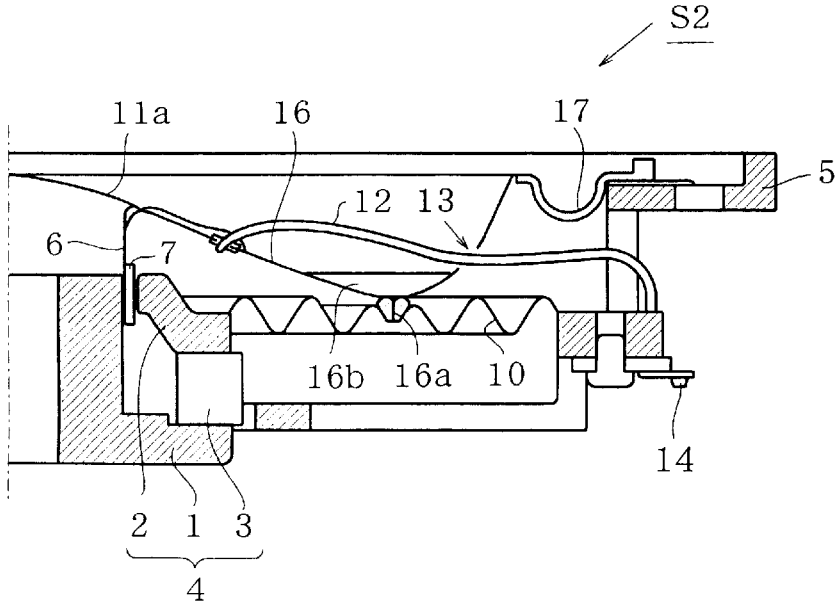
Figure 6:
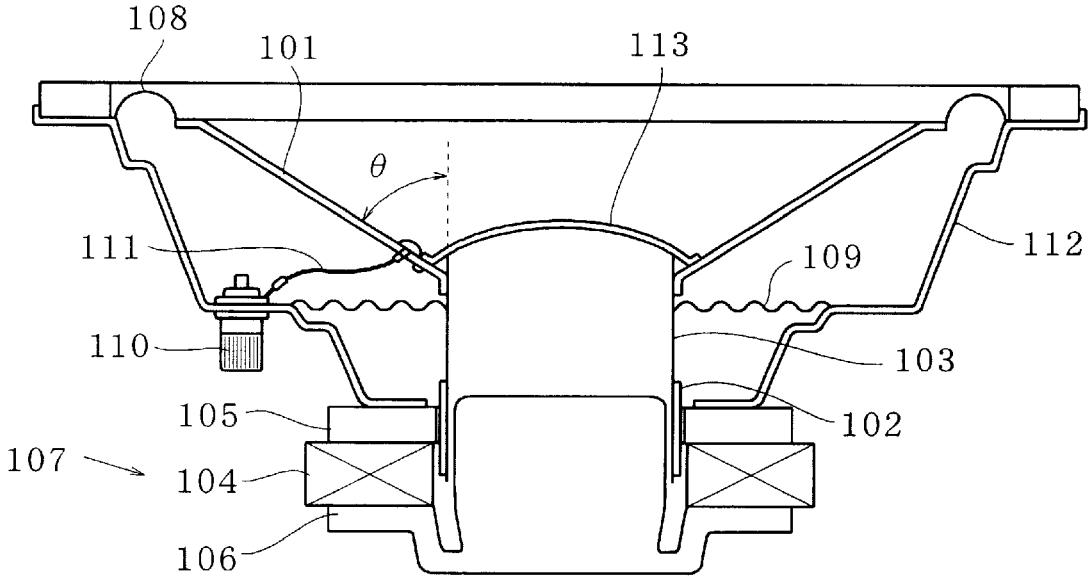
FIG.6 PRIOR ART
FIG. 6 is a sectional view of a conventional cone loudspeaker.

In another modification shown in FIG. 5, an inner periphery of a diaphragm 16 of a loudspeaker S2 is disposed at a lower position than the outer periphery thereof. Thus the height of the voice coil bobbin 6 can further be reduced. A center cap 11*a* of FIG. 5 may project upwardly in a sound radiating direction, provided the center cap does not interfere with the maximum amplitude needed for the speaker S2. Moreover. an edge 17 having a downwardly projecting section can be provided between the diaphragm 16 and the frame 5 so as to decrease the height of the loudspeaker S2. A ridge 16*a* and the reinforcement ribs 16*b* similar to the ridge 8*a* and the ribs 8*b* are further provided.

The present invention may further be modified to fill the holes 13 for allowing the leads 12 to be passed through the diaphragm 8 with an adhesive, for example. Thus the abutting of the leads 12 to the diaphragm 8 can be further reliably prevented.

From the foregoing it will be understood that the present invention provides a diaphragm radially folded between the inner and outer peripheries thereof, thereby enabling to decrease the height of the diaphragm, and hence the height of the loudspeaker.

Since the diaphragm is folded, the vibrating surface of the diaphragm is strengthened, thereby preventing the partial vibration to occur. Thus the loudspeaker has a wide reproduction frequency range from low to high ranges.

Due to the radially extending reinforcement ribs formed at the sound radiating side of the diaphragm, the sound radiating surface between the outer periphery and the ridge and the sound radiating surface between the inner periphery and the ridge are reinforced. Hence the partial vibration of the diaphragm is further prevented, thereby enabling to provide a wide reproduction frequency range from low to high ranges.

Since the diaphragm and the reinforcement ribs are integrally formed from synthetic resin, the diaphragm having a complicated shape can be easily and accurately formed, so that the diaphragm has a uniform acoustic characteristics. Thus the loudspeaker has a wide reproduction frequency range from low to high ranges.

The ridge of the diaphragm is supported by the damper having the outer periphery attached to the frame and the inner periphery attached to the magnetic circuit or the frame at the middle portion of the damper. The two vibrating surfaces of the diaphragm are resiliently supported at coaxial but radially different positions thereof, so that the diaphragm is stably supported. As a result, the rolling is prevented, the allowable input of the loudspeaker increased, and the loudspeaker consequently has a wide reproduction frequency range from low to high ranges.

The ridge of the diaphragm is attached to the damper at the middle portion between the outer and inner peripheries thereof. Hence a single damper can support the ridge having a diameter larger than the diameter of the voice coil bobbin from the inner and peripheral sides of the diaphragm. As a result, the rolling is prevented, the allowable input of the loudspeaker increased, and the loudspeaker has a wide reproduction frequency range from low to high ranges consequently.

While the invention has been described in conjunction with preferred specific embodiment thereof, it will be understood that this description is intended to illustrate and not limit the scope of the invention, which is defined by the following claims.

What is claimed is:

1. A loudspeaker having a frame, a magnetic circuit formed on the frame, a voice coil bobbin disposed in a magnetic gap of the magnetic circuit, and a diaphragm connected to the voice coil bobbin at an inner periphery and to the frame at an outer periphery thereof, wherein the diaphragm is folded at a position between the inner and outer peripheries thereof to form an annular ridge, whereby the annular ridge is projected in an axially inner direction of the loudspeaker;

wherein a damper is attached to the magnetic circuit at an inner periphery and to the frame at an outer periphery thereof; and wherein the annular ridge is fixed to the damper at a position between the inner and outer peripheries thereof.

2. The loudspeaker according to claim 1 wherein the ridge has a shape of a rib.

3. The loudspeaker according to claim 1 wherein a plurality of reinforcement ribs are provided between folded portions of the diaphragm, each of the reinforcement ribs is disposed in a radial direction of the loudspeaker.

4. The loudspeaker according to claim 1 wherein the diaphragm and the reinforcement ribs are integrally made of synthetic resin.

* * * * *